US010211575B2

(12) United States Patent
Zhao et al.

(10) Patent No.: US 10,211,575 B2
(45) Date of Patent: Feb. 19, 2019

(54) ELECTRICAL CONNECTOR EQUIPPED WITH AN OBLIQUE STRUCTURE FOR PROVIDING RECEIVING SPACE

(71) Applicant: FOXCONN INTERCONNECT TECHNOLOGY LIMITED, Grand Cayman (KY)

(72) Inventors: Jun Zhao, Huaian (CN); Cai-Yun Zhang, Huaian (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/817,321

(22) Filed: Nov. 20, 2017

(65) Prior Publication Data

US 2018/0151988 A1 May 31, 2018

(30) Foreign Application Priority Data

Nov. 25, 2016 (CN) ..... 2016 1 1059447

(51) Int. Cl.
*H01R 13/6594* (2011.01)
*H01R 13/405* (2006.01)
(Continued)

(52) U.S. Cl.
CPC ..... *H01R 13/6594* (2013.01); *H01R 13/405* (2013.01); *H01R 13/506* (2013.01); *H01R 13/6585* (2013.01); *H01R 13/6595* (2013.01); *H01R 12/57* (2013.01); *H01R 12/724* (2013.01); *H01R 24/60* (2013.01)

(58) Field of Classification Search
CPC ..... H01R 13/6594; H01R 12/724; H01R 13/405; H01R 13/506; H01R 13/6585
USPC ..... 439/607.05, 607.07, 607.13, 607.27, 439/607.35, 607.36
See application file for complete search history.

(56) References Cited

U.S. PATENT DOCUMENTS 6,786,770 B1 * 9/2004 Huang ..... H01R 13/6596 439/607.55
7,811,131 B2 * 10/2010 Wang ..... H01R 12/714 439/607.35
(Continued)

FOREIGN PATENT DOCUMENTS

CN 105406256 3/2016
CN 205863500 1/2017

*Primary Examiner* — Tulsidas C Patel
*Assistant Examiner* — Travis Chambers
(74) *Attorney, Agent, or Firm* — Wei Te Chung; Ming Chieh Chang

(57) ABSTRACT

An electrical connector adapted for mounting to an upper surface of the printed circuit board, includes a contact module having an insulative housing with a plurality of contacts disposed therein and enclosed within an inner metallic shell, and an outer metallic shell attached to the inner shell and located between the inner shell and the printed circuit board so as to allow the raised type mating cavity which is formed by the inner shell. The contact module includes a metallic shielding plate with an oblique section. The housing forms an oblique section on the rear side to comply with the oblique section of the shielding plate wherein a receiving space is formed above a rear side of the connector and in alignment with a mating cavity of the inner shell in the front-to-back direction.

20 Claims, 11 Drawing Sheets

(51) Int. Cl.

| | |
|---|---|
| ***H01R 13/506*** | (2006.01) |
| ***H01R 13/6585*** | (2011.01) |
| ***H01R 13/6595*** | (2011.01) |
| *H01R 12/72* | (2011.01) |
| *H01R 12/57* | (2011.01) |
| *H01R 24/60* | (2011.01) |

(56) References Cited

U.S. PATENT DOCUMENTS

| | | | | |
|---|---|---|---|---|
| 7,824,220 | B2 * | 11/2010 | Chen | H01R 13/6582 439/607.35 |
| 8,033,868 | B2 * | 10/2011 | Wang | H01R 13/405 439/660 |
| 8,920,197 | B2 * | 12/2014 | Tziviskos | H01R 13/405 439/660 |
| 2010/0330849 | A1 * | 12/2010 | Wang | H01R 24/60 439/701 |

* cited by examiner

ELECTRICAL CONNECTOR EQUIPPED WITH AN OBLIQUE STRUCTURE FOR PROVIDING RECEIVING SPACE

BACKGROUND OF THE DISCLOSURE

1. Field of the Disclosure

The invention is related to an electrical connector and particularly to the electrical connector adapted to be mounted to a printed circuit board and compliant with the device casing. The instant application relates to the copending application having the same inventors and the same applicant and titled "ELECTRICAL CONNECTOR EQUIPPED WITH DISCRETE BOTTOM PLATE FOR MOUNTING TO PCB"

2. Description of Related Arts

US Patent Application Publication No. 20170133795 discloses the so-called sink type connector which is located in a notch of the printed circuit board for a low profile arrangement, thus unfitting the device casing having the upper or standard level insertion opening for the electrical connector.

It is desired to provide an electrical connector which is essentially mounted upon the printed circuit board with proper support around the shell, and has the corresponding upper insulator and lower insulator both essentially extending in an oblique manner around for compliance with the obliquely extending retaining sections of the contacts.

SUMMARY OF THE DISCLOSURE

To achieve the above desire, an electrical connector adapted for mounting to an upper surface of the printed circuit board, includes a contact module having an insulative housing with a plurality of contacts disposed therein and enclosed within an inner metallic shell, and an outer metallic shell attached to the inner shell and located between the inner shell and the printed circuit board so as to allow the raised type mating cavity which is formed by the inner shell. The contact module includes a metallic shielding plate with an oblique section. The housing forms an oblique section on the rear side to comply with the oblique section of the shielding plate wherein a receiving space is formed above a rear side of the connector and in alignment with a mating cavity of the inner shell in the front-to-back direction

DETAILED DESCRIPTION OF THE PREFERRED EMBODIMENT

Figure 1:
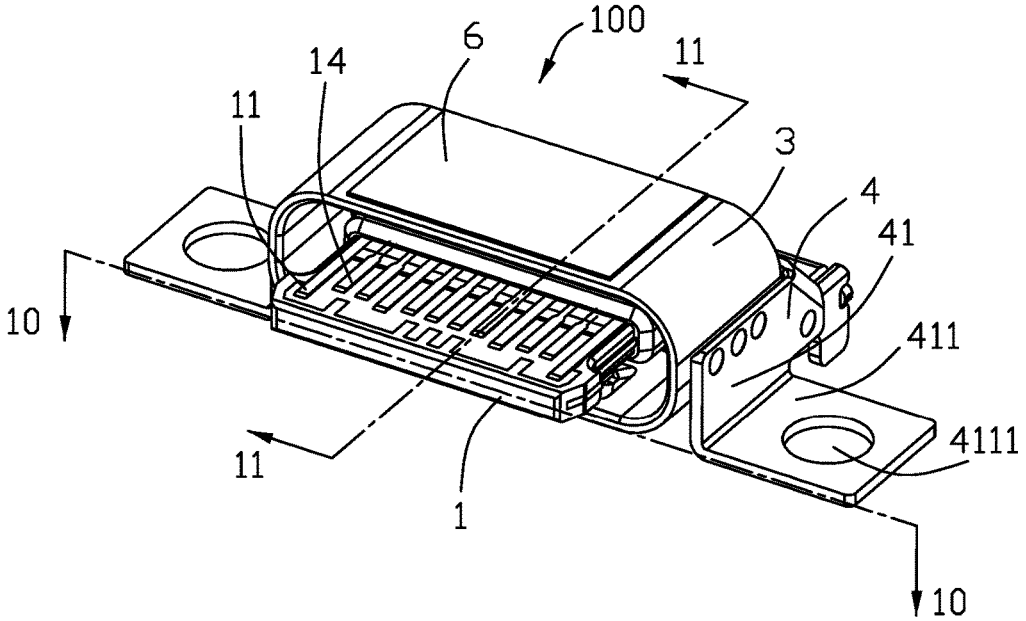
FIG. 1 is a front downward perspective view of an electrical connector mounted upon a printed circuit board according to the invention.
Figure 2:
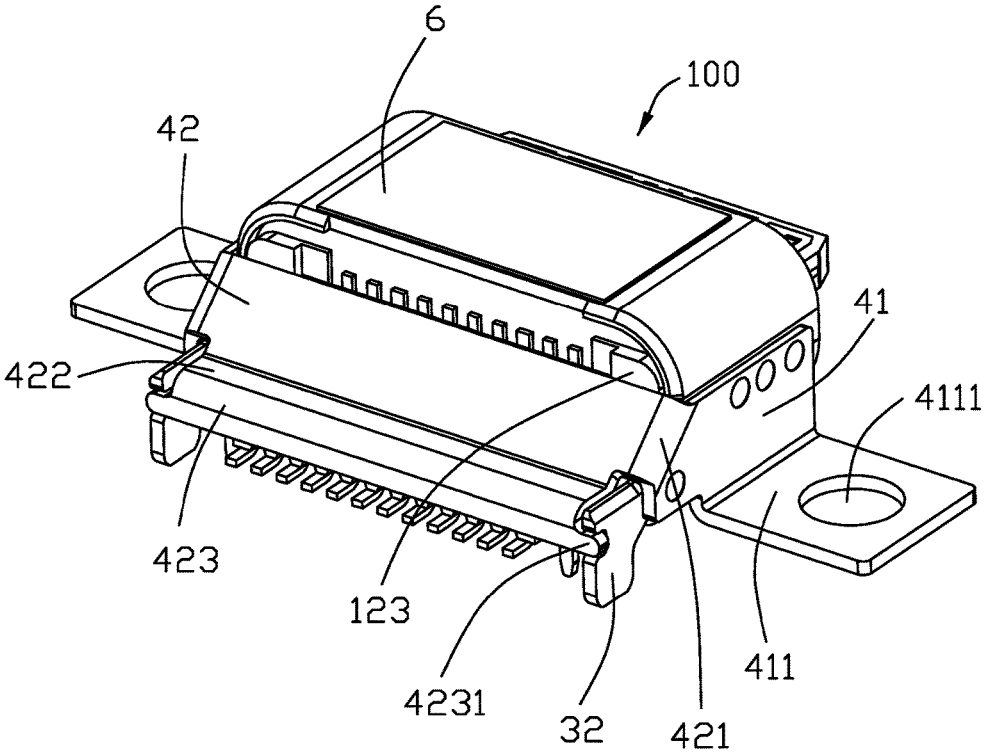
FIG. 2 is a rear downward perspective view of the electrical connector mounted upon the printed circuit board of FIG. 1.
Figure 3:
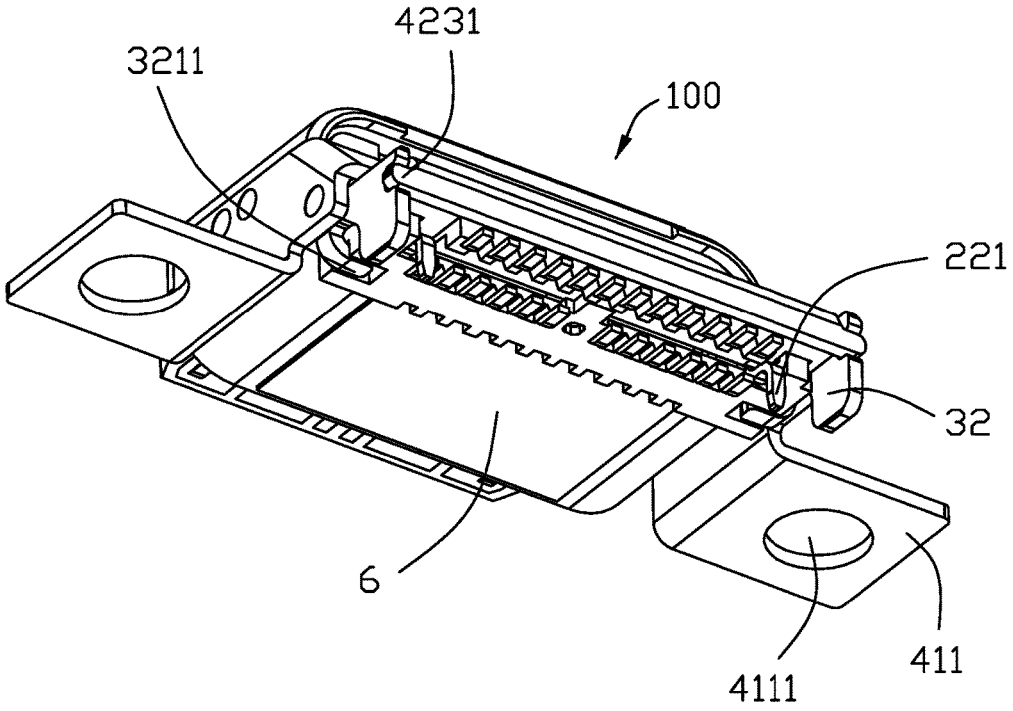
FIG. 3 is a rear upward perspective view of the electrical connector of FIG. 1.
Figure 4:
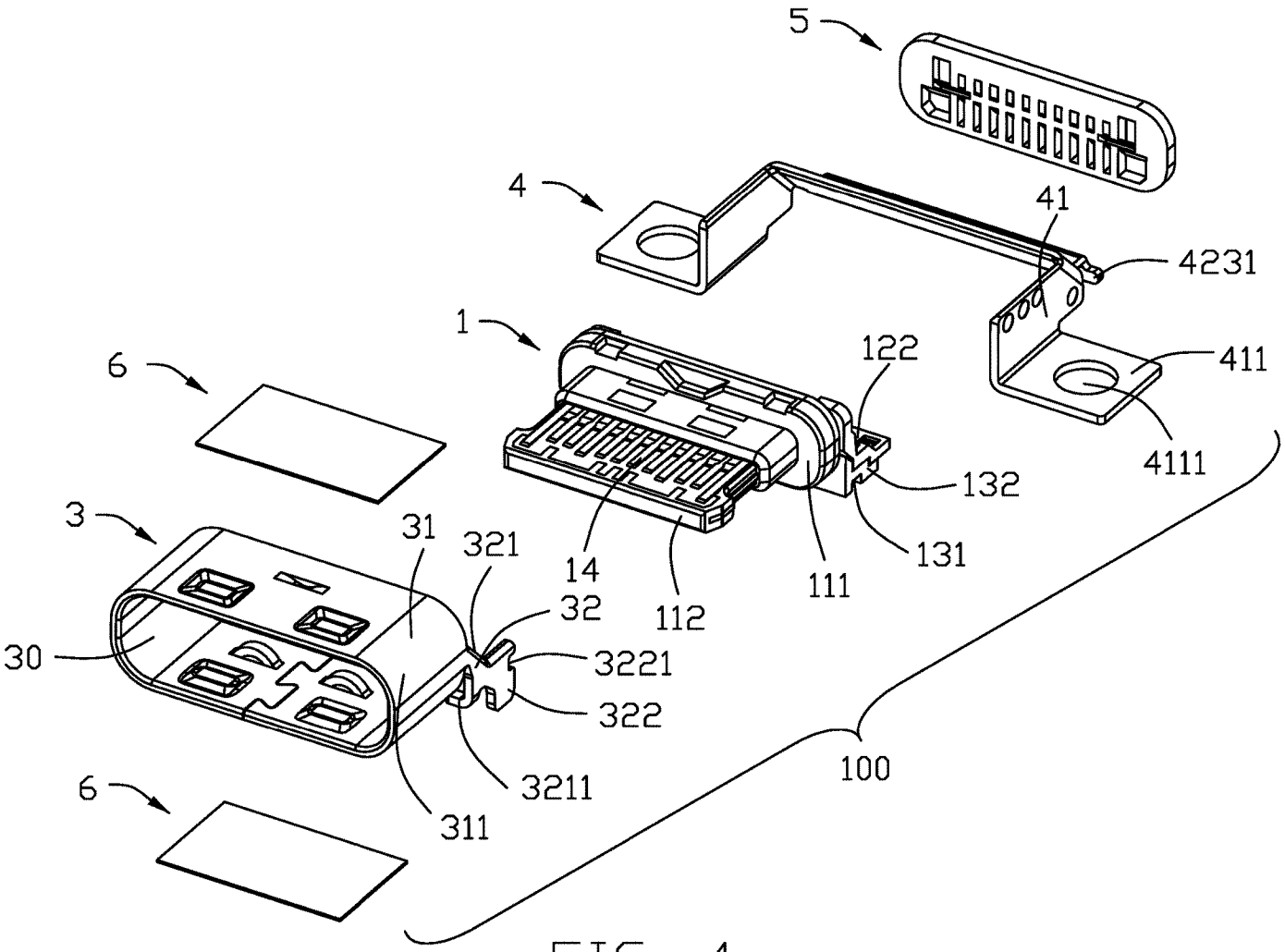
FIG. 4 is a front downward exploded perspective view of the electrical connector of FIG. 1.
Figure 5:
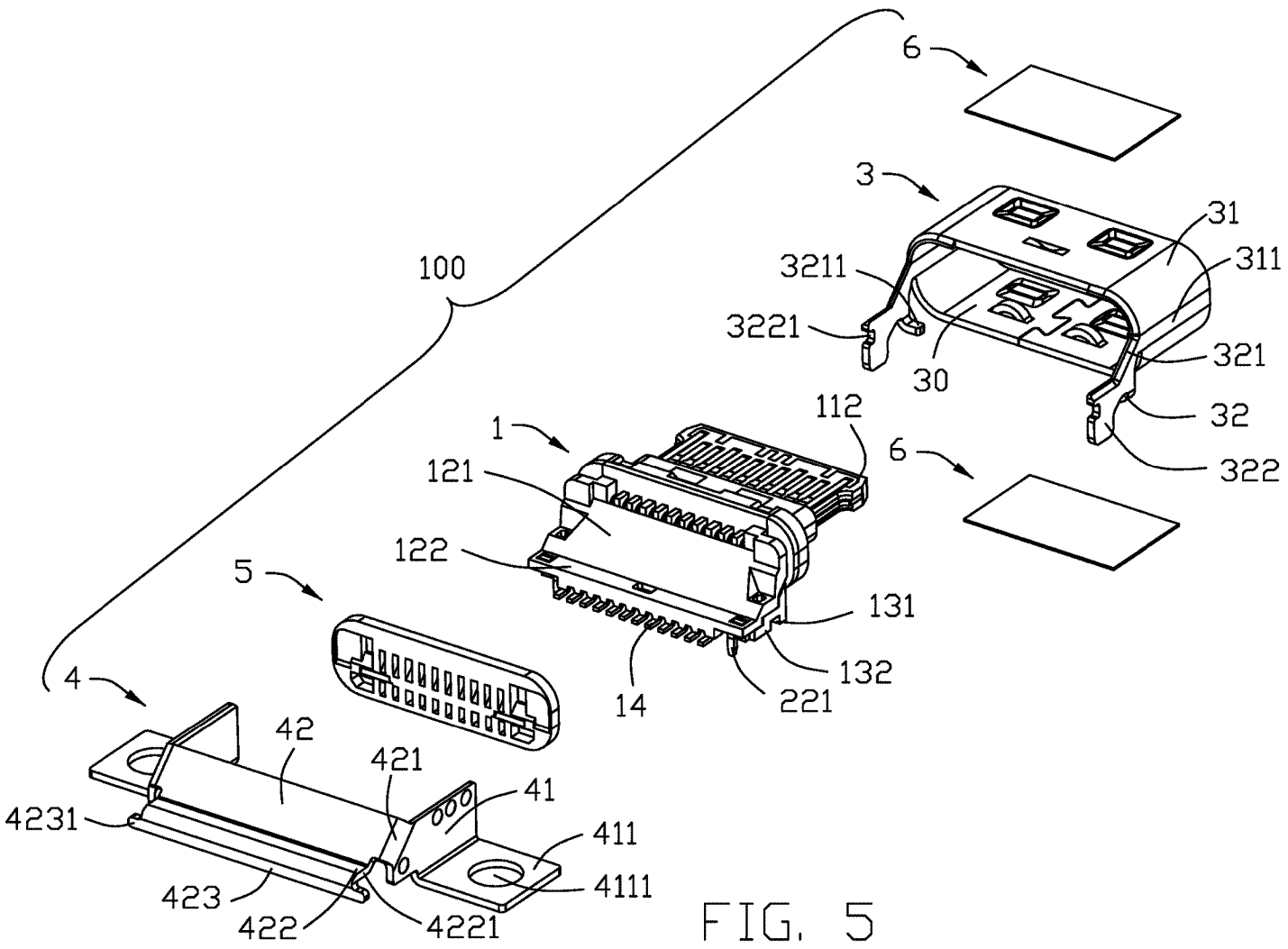
FIG. 5 is a rear downward exploded perspective view of the electrical connector of FIG. 2.
Figure 6:
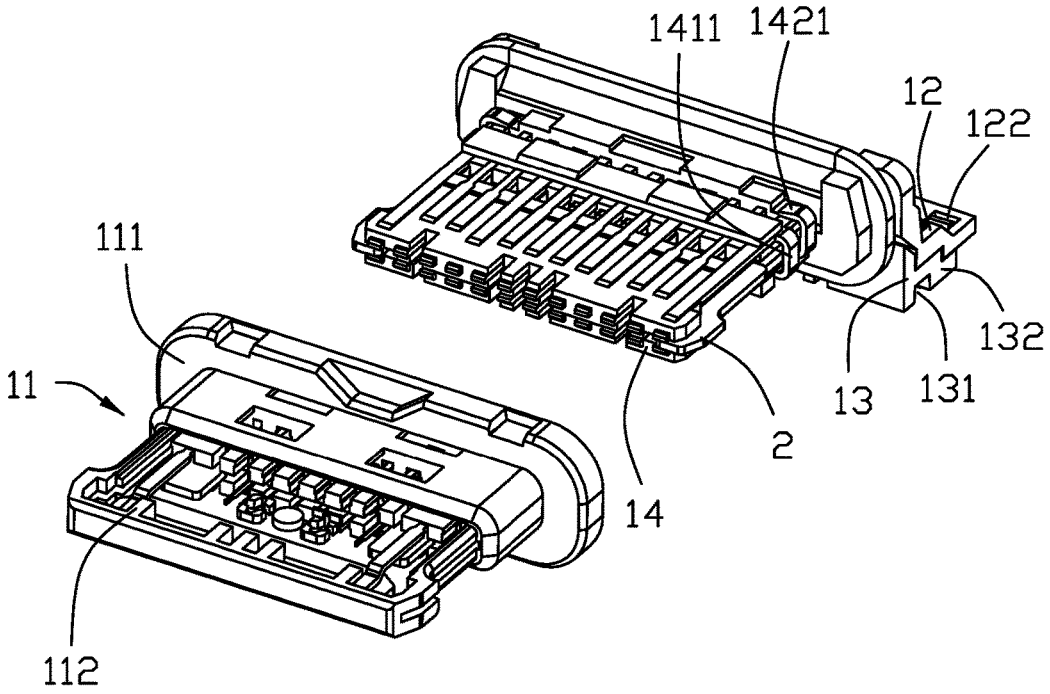
FIG. 6 is a front downward exploded perspective view of the contact module of the electrical connector of FIG. 3.
Figure 7:
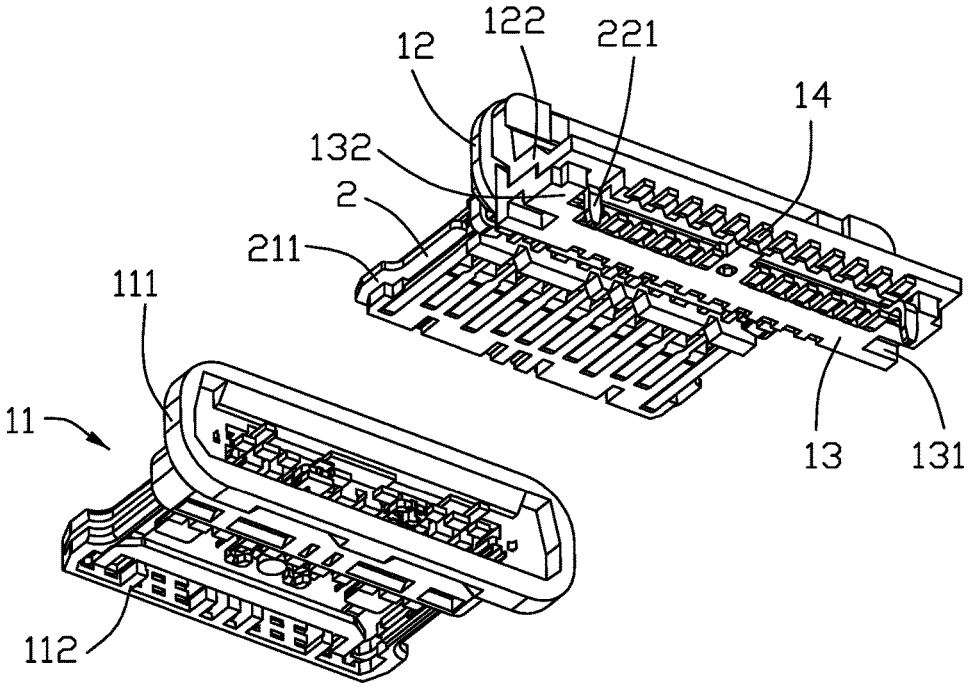
FIG. 7 is a rear upward exploded perspective view of the contact module of the electrical connector of FIG. 6.
Figure 8:
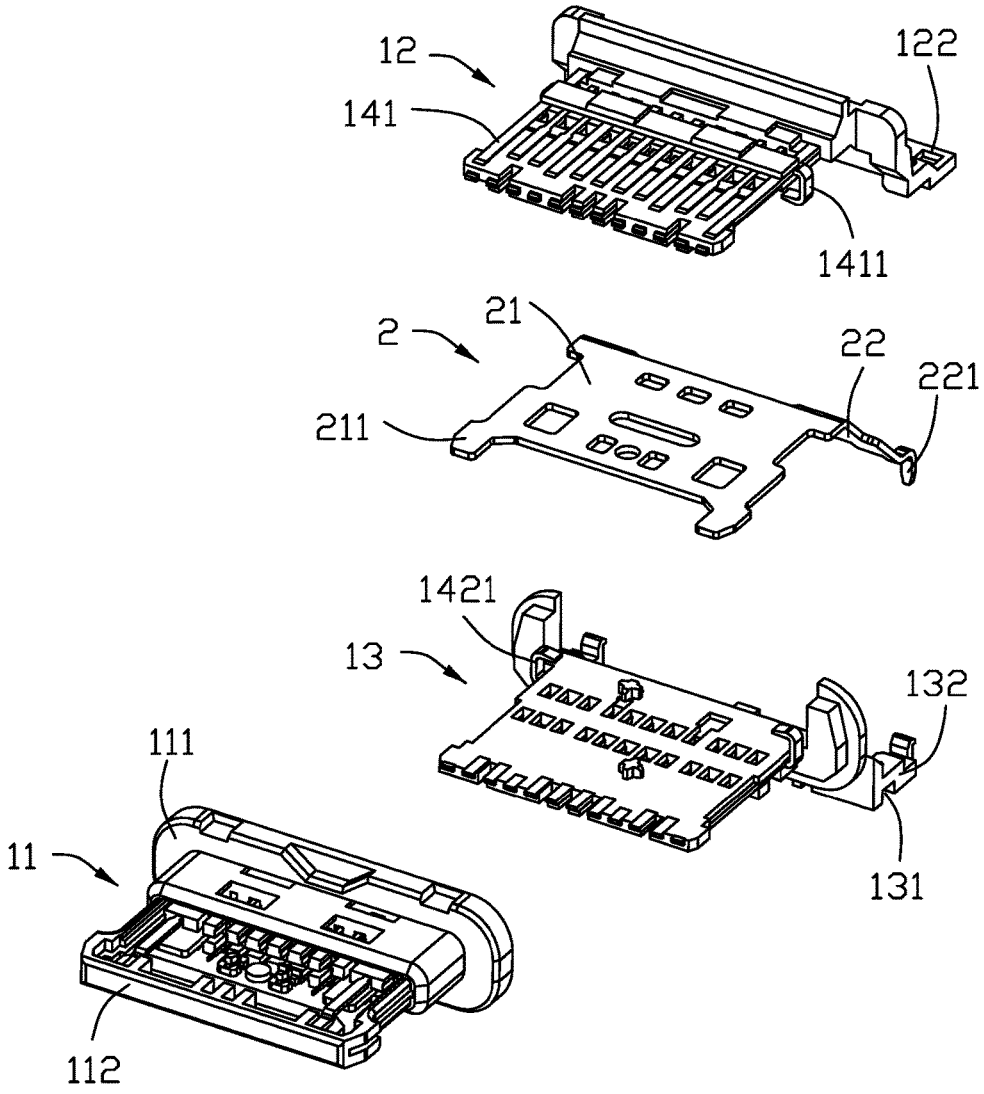
FIG. 8 is a further front downward exploded perspective view of the contact module of the electrical connector of FIG. 6.
Figure 9:
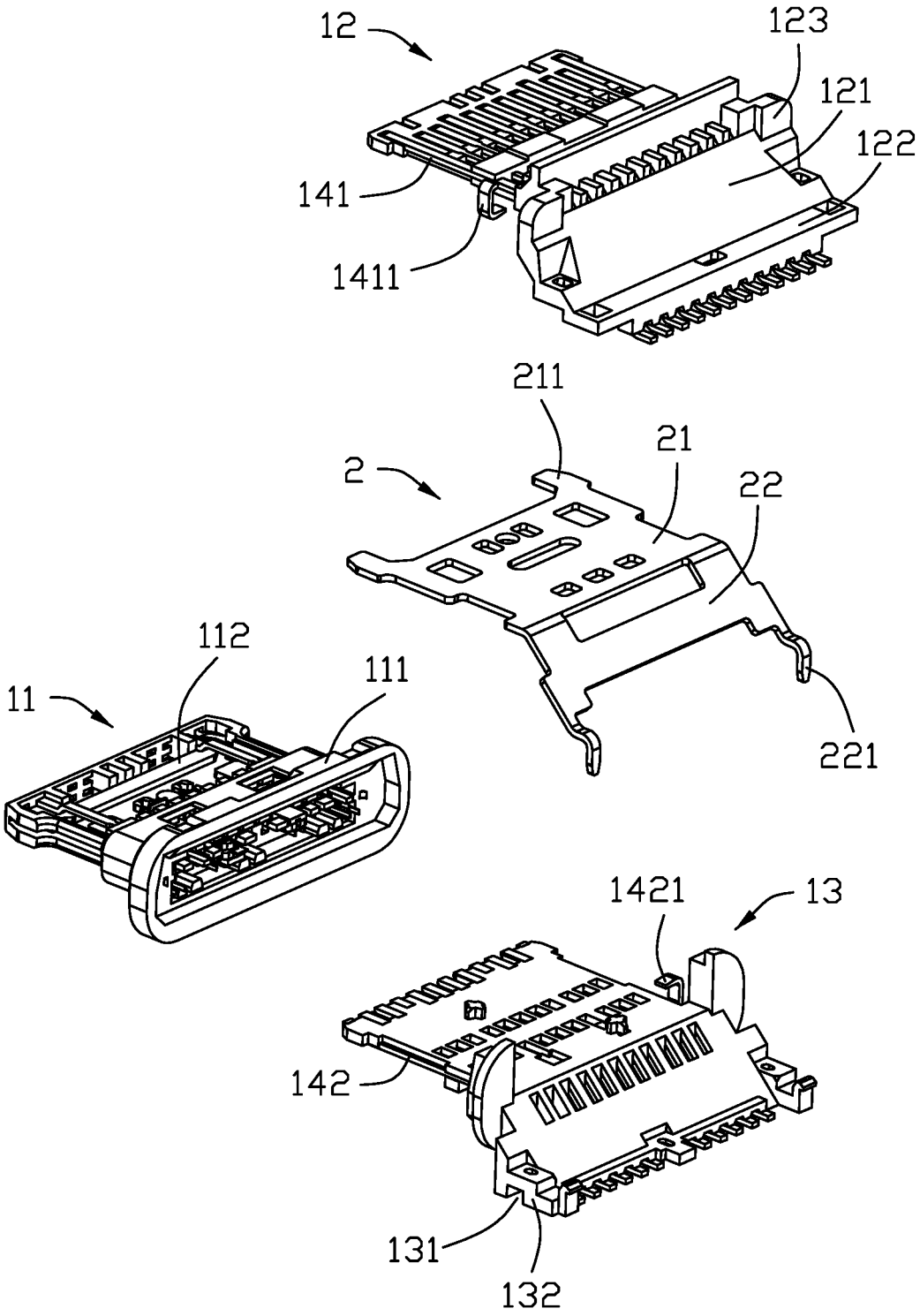
FIG. 9 is a further rear downward exploded perspective view of the contact module of the electrical connector of FIG. 7.
Figure 10:
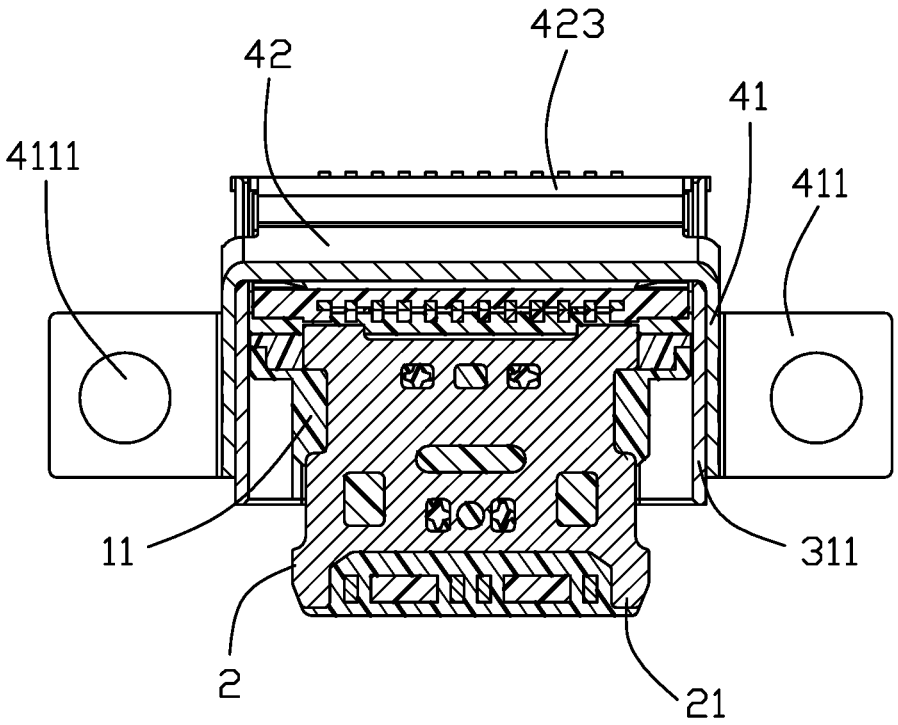
FIG. 10 is a cross-sectional view of t the electrical connector of FIG. 1.
Figure 11:
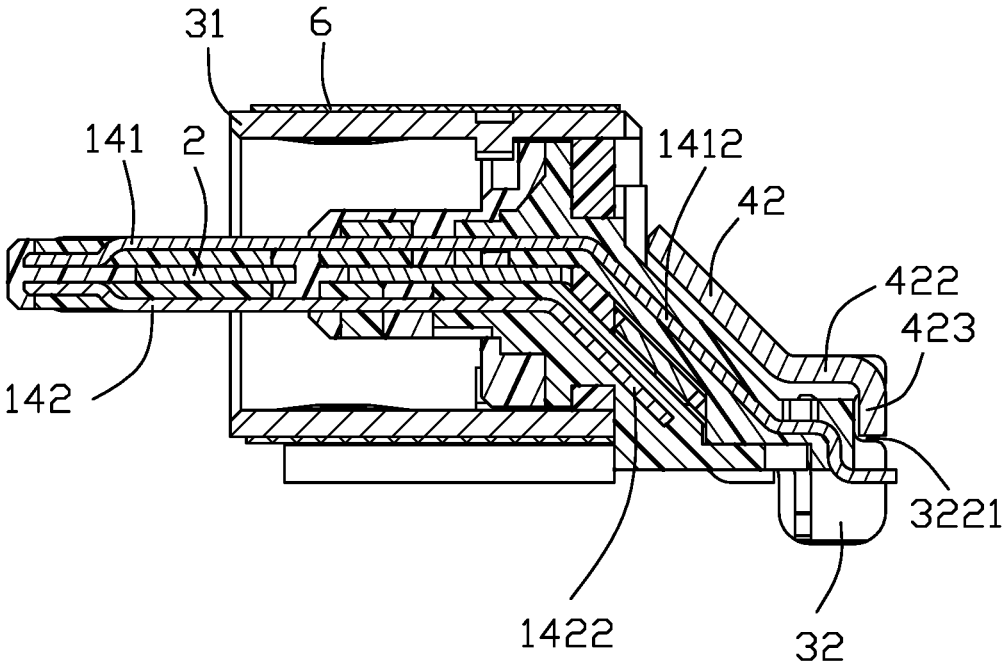
FIG. 11 is another cross-sectional view of the electrical connector of FIG. 1.

Reference will now be made in detail to the embodiments of the present disclosure. Referring to FIGS. 1-11, an electrical card connector 100 is used to be mounted to a printed circuit board (not shown). The electrical connector 100 includes a contact module 1, an inner metallic shell 3, an outer metallic shell 4, a waterproof plate 5 attached upon a rear side of the contact module 1, an insulating film 6 applied upon the upper surface and the lower surface of the inner shell 3.

The contact module 1 includes an insulative housing, a plurality of contacts 14 and a shielding plate 2 retained by the housing. The housing includes an upper insulator 12, a lower insulator 13 and a covering insulator 11 enclosing both the upper insulator 12 and the lower insulator 13. The shielding plate 2 is sandwiched between the upper insulator 12 and the lower insulator 13. The covering insulator 11 includes a base 111 and a mating portion 112 extending forwardly from the base 111 along the front-to-back direction. The upper insulator 12 includes an oblique portion 121, an upper abutment portion 122 extending rearwardly from a rear end thereof, and an upstanding wall 123 extending from a front end thereof. The lower insulator 13 includes a lower abutment portion 132 corresponding to the upper abutment portion 122, and a securing groove 131 in the abutment portion 132. Understandably, the insulative housing may be an unitary piece instead of the discrete pieces disclosed in the embodiment.

The contacts 14 includes the upper contacts 141 retained in the upper insulator 12 as an upper contact module, and the lower contacts 142 retained in the lower insulator 13 as the lower contact module. The two opposite outermost upper contacts 141 further include U-shaped first securing parts 1411 for securing the lower insulator 13. The upper contacts 141 further include the first oblique sections 1412 for compliance with the oblique portion 121. The two opposite outermost lower contacts 142 further include U-shaped second securing parts 1421 for securing the upper insulator 12. Through the first securing parts 1411 and the second securing parts 1421, the upper insulator 12 and the lower insulator 13 are securely assembled together. The lower contacts 142 further include the second oblique sections 1422 complying with the first oblique sections 1412. The upper contacts 141 and the lower contacts 142 are reversely symmetrical with each other and include the pair of grounding contacts, the pair of power contacts, two pairs of high speed differential signals and some signal contacts as defined in the specification of the so-call USB Type C connector. The upper contacts 141 and the lower contacts 142 have the corresponding soldering sections in a coplanar manner.

The shielding plate 2 includes a horizontal section 21 and an oblique section 22 extending rearwardly from the horizontal section 21 and abutting against the oblique portion 121. The horizontal section 21 further includes a pair of locking notches 211 for latching the complementary plug (not shown), and a pair of mounting legs 211 for mounting to the printed circuit board (not shown). The oblique section 22 is sandwiched between the upper insulator 12 and the lower insulator 13.

The inner shell 3 receiving the contact module 1, includes the tubular main body 31 forming the mating cavity 30, a pair of side faces 311 of the main body 31, the soldering sections 32 rearwardly extending from the side faces 311, respectively. The soldering section 32 includes an oblique section 321 and a soldering leg 322 extending from the end of the oblique section 321. The oblique section 321 includes a securing tab 3211 received within the securing groove 131 for retaining the contact module 1 to the inner shell 3. The soldering leg 322 further includes a notch 3221.

The outer shell 4 is attached to the inner shell 3. The outer shell 4 includes a pair of side securing pieces 41 attached upon the corresponding side faces 311, and the abutment section 42 between the pair of side securing pieces 41. The abutment section 42 is linked to the corresponding side securing piece 41 via the connection piece 421, and a covering section 422 is formed at the rear end of the abutment section 42. A covering plate 423 is formed on the covering section 422. The side securing piece 41 includes a horizontal securing plate 411 with a hole 4111 therein. The abutment section 42 covers the oblique portion 121 compliantly. The abutment section 42 abuts against the upstanding wall 123 for preventing rearwardly movement of the contact module 1 with regard to the secured inner shell 3 and the outer shell 4. In this embodiment, the connection piece 421 corresponds to the oblique section 321. The covering section 422 covers the upper abutment portion 122 and preferably abuts against the abutment portion 122. The covering plate 423 abuts against the rear end of the upper abutment portion 122 for preventing rearward movement of the contact module 1. The covering plate 423 includes locking tabs 4231 in the corresponding notch 3221. Notably, the locking tab 4231 may be formed on the abutment section 42 or the covering section 422. Under such conditions, the corresponding notch 3221 may change the position correspondingly. The covering section 422 is sandwiched between the pair of soldering legs 322 so as to assure the reliable positions between the inner shell 3 and the outer shell 4.

The waterproof plate 5 is formed by glue and attached on a rear side of the contact module 1 around a rear end of the inner shell 3. The abutment section 42 abuts forwardly against the waterproof plate 5. The pair of insulative films 6 are attached upon the upper and lower surfaces of the inner shell 3. Notably, in the instant invention, a receiving space (not labeled) is formed above the abutment section 42 and essentially in alignment with the mating cavity 30 for receiving the potential electronic part thereabouts in the electronic device. In other words, the oblique arrangement of the abutment section 42, oblique portion 121, the abutment section 22, the first oblique section 1421 and the second oblique section 1422 and the oblique surface on the lower insulator 13 under the receiving space (not labeled) all are the features of the invention, compare with the traditional ones without any receiving space above those parts. In brief, the oblique structure of the whole connector 100 or the contact module 1 with the receiving space above is the important feature of the invention.

While a preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. An electrical connector comprising:

a contact module including:

an insulative housing having a base and a tongue portion extending forwardly from the base in a front-to-back direction; and a plurality of contacts disposed in the housing; and a metallic inner shell enclosing the contact module, said metallic inner shell forming a mating cavity in which the tongue portion extends; wherein the contact module includes an oblique structure extending from an upper front position to a rear lower position thereof in a side view so as to form a receiving space located above said oblique structure in a vertical direction, and aligned with the mating cavity along a front-to-back direction perpendicular to the vertical direction; and the contact module includes a plurality of upper contacts and a plurality of lower contacts with a metallic shielding plate therebetween, the upper contacts have corresponding first oblique sections, the lower contacts have corresponding second oblique sections, and the shielding plate has a corresponding oblique section all complying with the oblique structure.

2. The electrical connector as claimed in claim 1, further including a metallic outer shell attached to the inner shell and equipped with an abutment section covering the oblique structure in an oblique manner.

3. The electrical connector as claimed in claim 2, wherein said abutment section forwardly abuts against a corresponding upstanding wall of the housing for preventing rearward movement of the contact module relative to the inner shell.

4. The electrical connector as claimed in claim 2, wherein the metallic outer shell further includes a pair of securing pieces on two sides of the abutment section in a transverse direction perpendicular to both said vertical direction and the front-to-back direction, each of said securing pieces is attached to the inner shell and forms a horizontal securing plate with a hole therein.

5. The electrical connector as claimed in claim 4, wherein a covering section extends rearwardly from the abutment section of the outer shell and abuts against an abutment portion of the contact module in the vertical direction.

6. The electrical connector as claimed in claim 5, wherein a covering plate is formed below the covering section with two opposite locking tabs retained to a pair of soldering legs unitarily extending rearwardly from the inner shell.

7. The electrical connector as claimed in claim 5, wherein the housing includes both an upper insulator integrally formed with the upper contacts, and a lower insulator integrally formed with the lower contacts, both said upper insulator and said lower insulator forming corresponding oblique portions to sandwich the oblique section of the shielding plate therebetween compliantly.

8. The electrical connector as claimed in claim 1, wherein the inner shell includes a pair of soldering sections on two lateral sides in a transverse direction perpendicular to both said front-to-back direction and said vertical direction, and said pair of soldering sections form corresponding oblique sections for compliance with the oblique structure.

9. The electrical connector as claimed in claim 8, wherein said soldering sections further include a pair of securing tabs received in a pair of corresponding securing grooves in an underside of the housing, respectively.

10. The electrical connector as claimed in claim 8, wherein each soldering section forms an oblique contour in compliance with the abutment section of the outer shell.

11. The electrical connector as claimed in claim 8, further including a metallic outer shell attached to the inner shell and equipped with an abutment section covering the oblique structure in an oblique manner, wherein the metallic outer shell further includes a pair of securing pieces on two sides of the abutment section in said transverse direction, each of said securing pieces is attached to the inner shell and forms a horizontal securing plate with a hole therein.

12. The electrical connector as claimed in claim 11, wherein the pair of soldering sections are located by two sides of the abutment section in the transverse direction.

13. An electrical connector comprising:

a contact module including:

an insulative housing having a base and a tongue portion extending forwardly from the base in a front-to-back direction; and a plurality of contacts disposed in the housing;

a metallic inner shell enclosing the contact module, said metallic shell forming a mating cavity in which the tongue portion extends; and a metallic outer shell secured to the inner shell and having a pair of securing piece located by two side of the inner shell in a transverse direction perpendicular to said front-to-back direction, and an abutment section unitarily linked between said pair of securing pieces to abut forwardly against the housing for preventing rearward movement of the contact module with regard to the inner shell; wherein the outer shell further includes an oblique section on a rear side to extend along a front upper position to a rear lower position to form above a receiving space in alignment with the mating cavity in the front-to-back direction.

14. The electrical connector as claimed in claim 13, wherein the front end of the oblique section of the outer shell abuts against an upstanding wall of the housing.

15. The electrical connector as claimed in claim 13, wherein the inner shell further includes a pair of soldering sections with soldering legs thereof, and the soldering section forms an oblique contour in compliance with the oblique section of the outer shell.

16. The electrical connector as claimed in claim 15, wherein the contact module includes a metallic shielding plate having an oblique section thereof in compliance with the oblique section of the outer shell.

17. The electrical connector as claimed in claim 16, wherein the contacts have corresponding oblique sections in compliance with the oblique sections of the outer shell.

18. The electrical connector as claimed in claim 17, wherein the housing includes an upper insulator and a lower insulator, both of which form corresponding oblique structures.

19. An electrical connector comprising:

a contact module including:

an insulative housing having a base and a tongue portion extending forwardly from the base in a front-to-back direction; and a plurality of contacts disposed in the housing;

a metallic inner shell enclosing the contact module, said metallic inner shell forming a mating cavity in which the tongue portion extends; and a metallic outer shell attached to the inner shell; wherein the contact module includes an oblique structure extending from an upper front position to a rear lower position thereof in a side view so as to form a receiving space located above said oblique structure in a vertical direction and aligned with the mating cavity along a front-to-back direction perpendicular to the vertical direction; and the metallic outer shell is equipped with an abutment section covering the oblique structure in an oblique manner.

20. An electrical connector comprising:

a contact module including:

an insulative housing having a base and a tongue portion extending forwardly from the base in a front-to-back direction; and a plurality of contacts disposed in the housing; and a metallic inner shell enclosing the contact module, said metallic inner shell forming a mating cavity in which the tongue portion extends; wherein the contact module includes an oblique structure extending from an upper front position to a rear lower position thereof in a side view so as to form a receiving space located above said oblique structure in a vertical direction and aligned with the mating cavity along a front-to-back direction perpendicular to the vertical direction; and the inner shell includes a pair of soldering sections on two lateral side in a transverse direction perpendicular to both said front-to-back direction and said vertical direction, and said pair of soldering sections form corresponding oblique sections for compliance with the oblique structure.

* * * * *